US008770739B2

(12) United States Patent
Kikkawa et al.

(10) Patent No.: US 8,770,739 B2
(45) Date of Patent: Jul. 8, 2014

(54) IMAGE FORMING APPARATUS

(71) Applicants: Fumitaka Kikkawa, Kanagawa (JP); Yoichi Ito, Tokyo (JP); Mikio Ohashi, Kanagawa (JP); Soyoung Park, Kanagawa (JP)

(72) Inventors: Fumitaka Kikkawa, Kanagawa (JP); Yoichi Ito, Tokyo (JP); Mikio Ohashi, Kanagawa (JP); Soyoung Park, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/027,521

(22) Filed: Sep. 16, 2013

(65) Prior Publication Data

US 2014/0092153 A1 Apr. 3, 2014

(30) Foreign Application Priority Data

Oct. 1, 2012 (JP) ..... 2012-219800

(51) Int. Cl.
*B41J 2/01* (2006.01)

(52) U.S. Cl.
USPC ..... 347/105

(58) Field of Classification Search
USPC ..... 347/16, 104, 105
See application file for complete search history.

(56) References Cited

U.S. PATENT DOCUMENTS

| | | | | |
|---|---|---|---|---|
| 7,354,129 | B2 * | 4/2008 | Uchida | 347/19 |
| 8,083,343 | B2 * | 12/2011 | Ikuno et al. | 347/105 |
| 8,646,905 | B2 * | 2/2014 | Iijima et al. | 347/104 |
| 2011/0141181 | A1 | 6/2011 | Ito et al. | |
| 2012/0081487 | A1 | 4/2012 | Tanaka et al. | |
| 2012/0113180 | A1 | 5/2012 | Tanaka et al. | |
| 2012/0113204 | A1 | 5/2012 | Tanaka et al. | |
| 2012/0155916 | A1 | 6/2012 | Ito et al. | |
| 2013/0020753 | A1 | 1/2013 | Ito | |

FOREIGN PATENT DOCUMENTS

| | | |
|---|---|---|
| JP | 2006-349754 | 12/2006 |
| JP | 2012-136034 | 7/2012 |

* cited by examiner

*Primary Examiner* — Lamson Nguyen
(74) *Attorney, Agent, or Firm* — Cooper & Dunham LLP

(57) ABSTRACT

An image forming apparatus includes an apparatus body; an openable and closable cover provided at the apparatus body; a conveyance unit to convey a recording medium upward and downward; a recording head to eject liquid droplets to the recording medium conveyed by the conveyance unit; and an opening authorization mechanism to authorize moving of the conveyance unit from a first open position to a second open position, the conveyance unit having a greater opening amount at the second open position than at the first open position, wherein the conveyance unit is disposed between the cover and the recording head, and configured to be openable to the first open position when the cover is in the open position, and openable to the second open position when the opening authorization mechanism authorizes the moving of the conveyance unit from the first open position to the second open position.

6 Claims, 11 Drawing Sheets

IMAGE FORMING APPARATUS

CROSS-REFERENCE TO RELATED APPLICATIONS

This patent application is based on and claims priority pursuant to 35 U.S.C. §119 from Japanese Patent Application No. 2012-219800, filed on Oct. 1, 2012 in the Japan Patent Office, which is hereby incorporated by reference herein in its entirety.

BACKGROUND

1. Technical Field

Exemplary aspects of the present disclosure generally relate to an image forming apparatus.

2. Related Art

Image forming apparatuses are used as printers, facsimile machines, copiers, plotters, or multi-functional devices having at least one of printing, copying, plotting, and facsimile capabilities. As one type of image forming apparatus employing a liquid-ejection recording method, an inkjet recording apparatus is known that uses a recording head (liquid ejection head) for ejecting droplets of ink.

For example, JP-20120136034-A proposes an image forming apparatus including an openable and closable cover provided in an apparatus body, a conveyance unit disposed at the inner side of the cover to convey a recording medium in an upward and downward direction, and a recording head to eject liquid droplets from nozzles toward the recording medium conveyed by the conveyance unit. The conveyance unit is disposed between the cover and a nozzle formed face of the recording head at which the nozzles are formed. When the cover is opened, the conveyance unit moves in a direction in which the cover is opened, thus widening a space between the conveyance unit and the nozzle formed face of the recording head.

An advantage of the above-described configuration is that, when a sheet jam occurs, the sheet jam is easily cleared by first opening the cover and then opening the conveyance unit.

However, if the conveyance unit is opened widely (e.g. 90°) like the cover, a droplet ejecting face of the recording head in a carriage that has stopped due to the sheet jam is exposed to the outside.

Accordingly, if an apparatus user can easily touch the droplet ejecting face of the recording head, accidental adhering of liquid droplets to the apparatus user's hand may occur and foreign matter may adhere to the nozzles, thus resulting in deterioration in image quality.

If the opening angles of the cover and the conveyance unit are restricted so that the apparatus user is prevented from easily touching the droplet ejecting face, maintenance works, such as the maintenance of the droplet ejecting face and implementation of countermeasures for other failures by a serviceperson, are hindered.

SUMMARY

In view of the foregoing, in an aspect of this disclosure, there is provided a novel image forming apparatus including an apparatus body, an openable and closable cover provided at the apparatus body, a conveyance unit to convey a recording medium upward and downward, a recording head to eject liquid droplets to the recording medium conveyed by the conveyance unit to form an image on the recording medium, and an opening authorization mechanism to authorize moving of the conveyance unit from a first open position to a second open position, the first open position located at a position in same direction as a direction in which the cover is opened, the conveyance unit having a greater opening amount at the second open position than at the first open position. The conveyance unit is disposed between the cover and the recording head, and configured to be openable to the first open position when the cover is in the open position, and openable to the second open position when the opening authorization mechanism authorizes the moving of the conveyance unit from the first open position to the second open position.

The aforementioned and other aspects, features, and advantages will be more fully apparent from the following detailed description of illustrative embodiments, the accompanying drawings, and the associated claims.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
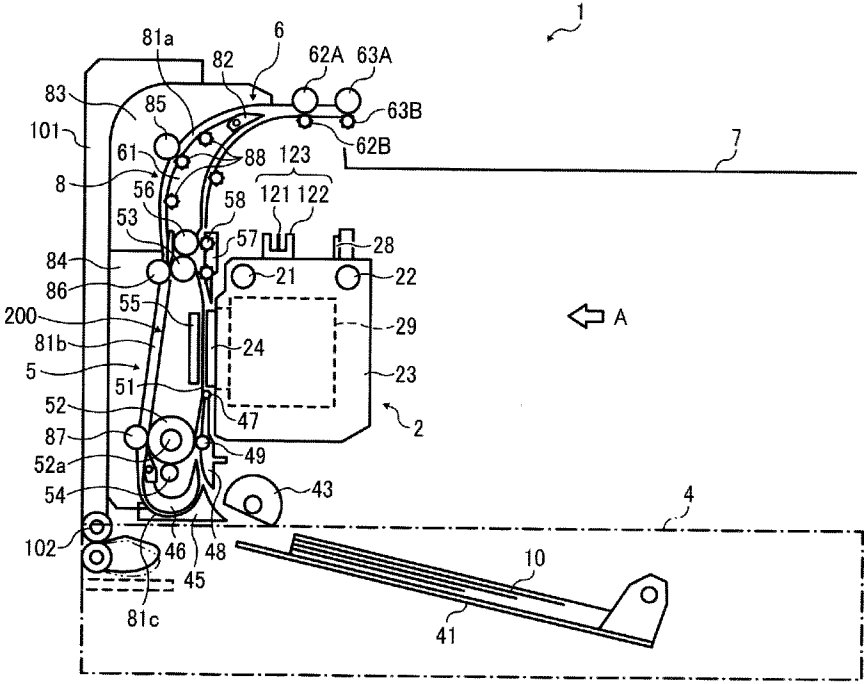
FIG. 1 is a schematic side view of a mechanical section of an image forming apparatus according to an exemplary embodiment of the present disclosure.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

In the present disclosure, the term "sheet" used herein is not limited to a sheet of paper and includes anything such as OHP (overhead projector) sheet, cloth sheet, glass sheet, or substrate on which ink or other liquid droplets can be attached. In other words, the term "sheet" is used as a generic term including a recording medium, a recorded medium, a recording sheet, and a recording sheet of paper. The terms "image formation," "recording," "printing," "image recording," and "image printing" are used herein as synonyms for one another.

The term "image forming apparatus" refers to an apparatus that ejects liquid on a medium to form an image on the medium. The medium is made of, for example, paper, string, fiber, cloth, leather, metal, plastic, glass, timber, and ceramic. The term "image formation" includes providing not only meaningful images such as characters and figures but meaningless images such as patterns to the medium (in other words, the term "image formation" also includes only causing liquid droplets to land on the medium).

The term "ink" is not limited to "ink" in a narrow sense, unless specified, but is used as a generic term for any types of liquid usable as targets of image formation. For example, the term "ink" includes recording liquid, fixing solution, DNA sample, resist, pattern material, resin, and so on.

The term "image" used herein is not limited to a two-dimensional image and includes, for example, an image applied to a three dimensional object and a three dimensional object itself formed as a three-dimensionally molded image.

Exemplary embodiments of the present disclosure, unless particularly specified, are applicable to both a serial-type image forming apparatus and a line-type image forming apparatus.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

First, an image forming apparatus according to an exemplary embodiment of the present disclosure is described with reference to FIG. 1 and FIG. 2.

FIG. 1 is a schematic side view of a mechanical section of the image forming apparatus. FIG. 2 is a schematic front view of the mechanical section seen from a direction indicated by an arrow A in FIG. 1.

In FIG. 1, the image forming apparatus is a serial-type image forming apparatus and includes, e.g., an image forming unit 2 and a conveyance device 5 in an apparatus body 1. The conveyance device 5 includes a conveyance unit. A sheet feed tray 4 is disposed at a lower side of the apparatus body 1 to load sheets 10 serving as recording media.

The conveyance device 5 receives a sheet 10 sent from the sheet feed tray 4 and conveys the sheet 10 in a vertical direction (upward direction). While the sheet 10 is intermittently conveyed by the conveyance device 5, the image forming unit 2 horizontally ejects droplets of ink or other liquid to record a desired image on the sheet 10. A sheet output unit 6 conveys the sheet 10 having the image recorded thereon further upward and outputs the sheet 10 to the sheet output tray 7 disposed at an upper side of the apparatus body 1.

In duplex printing, after a first face (front face) of the sheet 10 is printed, the sheet 10 partially output to the sheet output tray 7 is incorporated into and reversed by a sheet reverse unit 8. The conveyance device 5 conveys the sheet 10 in a direction opposite to the upward direction (that is, downward in the vertical direction) and feeds the sheet 10 to the conveyance device 5 again so that the image forming unit 2 can print an image on a second face (back face) of the sheet 10. After the second face of the sheet 10 is printed, the sheet 10 is discharged to the sheet output tray 7.

For the image forming unit 2, a carriage 23 mounting, e.g., recording heads 24*a* and 24*b* (collectively referred to as "recording heads 24" unless distinguished) is slidably supported by a main guide member 21 and a sub-guide member 22 extending between a left side plate 11L and a right side plate 11R. The carriage 23 is moved for scanning in a main scanning direction (indicated by an arrow in FIG. 2) by a main scanning motor 25 via a timing belt 28 extending between a driving pulley 26 and a driven pulley 27.

The carriage 23 mounts, for example, the recording heads 24*a* and 24*b* to eject ink droplets of, e.g., yellow (Y), magenta (M), cyan (C), and black (K). The recording heads 24 having multiple nozzle rows are mounted on the carriage 23 so that multiple nozzles of each of the nozzle rows are arrayed in line in a sub-scanning direction perpendicular to the main scanning direction and ink droplets are ejected from the nozzles in the substantially horizontal direction.

Each of the recording heads 24*a* and 24*b* has two nozzle rows. For example, one of the nozzles rows of the recording head 24*a* ejects liquid droplets of black (K) and the other ejects liquid droplets of cyan (C). One of the nozzles rows of the recording head 24*b* ejects liquid droplets of magenta (M) and the other ejects liquid droplets of yellow (Y). In some embodiments, each of the recording heads has a nozzle face at which nozzle rows for the respective colors are arranged.

As pressure generators for generating pressure to eject liquid droplets, droplet ejection heads (i.e. the droplet ejection face) forming the recording heads 24 may employ, for example, piezoelectric actuators such as piezoelectric elements, thermal actuators that generate film boiling of liquid (ink) using electro/thermal converting elements such as heat-generation resistant to cause phase change, shape-memory-alloy actuators that change metal phase by a temperature change, or electrostatic actuators that generate pressure by electrostatic force. The carriage 23 may mount liquid ejection heads for ejecting fixing solution that can enhance the fixing performance of ink by reacting with the ink.

The carriage 23 further mounts head tanks 29 to supply different color inks to the corresponding nozzle rows of the recording heads 24. The head tanks 29 receive the respective color inks from corresponding ink cartridges (main tanks) removably mounted in the apparatus body 1.

The image forming apparatus includes a linear encoder (main scanning encoder) 123 to detect movement of the carriage 23. The linear encoder (hereinafter referred to as main scanning encoder) 123 includes an encoder scale 121 and an encoder sensor 122. The encoder scale 121 with a predetermined pattern extends in the main scanning direction of the carriage 23 between the left side plate 11L and the right side plate 11R. The encoder sensor 122 is, e.g., a transmissive photosensor and is provided at the carriage 23 to read the pattern of the encoder scale 121.

Figure 2:
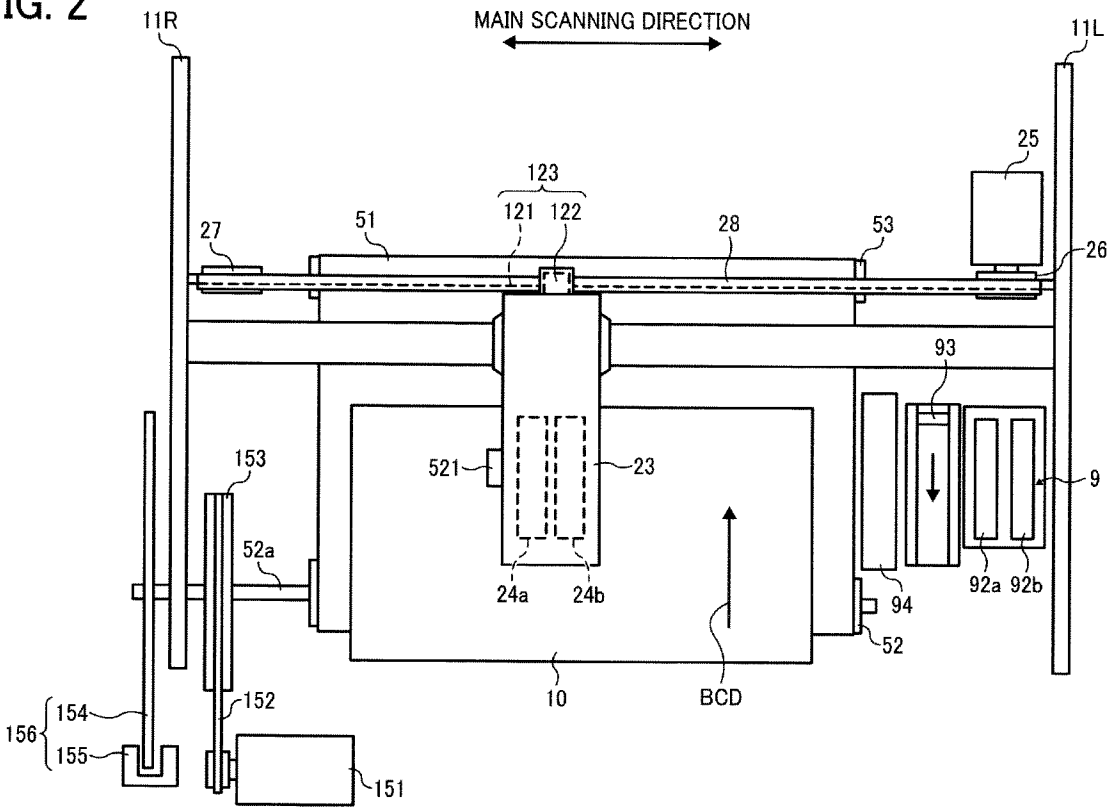
FIG. 2 is a schematic front view of the mechanical section seen from a direction indicated by an arrow A in FIG. 1.

In FIG. 2, at a non-print area on one end in the main-scanning direction of the carriage 23 is disposed a maintenance unit 9 to maintain and recover conditions of the nozzles of the recording head 24. The maintenance device 9 includes caps 92*a* and 92*b*, a wiping member 93, and a dummy-ejection receptacle 94. The caps 92*a* and 92*b* (hereinafter, collectively referred to as "caps 92" unless distinguished) cap nozzle faces of the recording heads 24. The wiping member (wiper blade) 93 serves as a blade member to wipe the nozzle faces of the recording heads 24 in the direction of the arrow in FIG. 2. The dummy-ejection receptacle 94 receives liquid droplets ejected by dummy ejection in which liquid droplets not contributing to image recording are ejected to remove viscosity-increased recording liquid.

The sheets 10 placed on a sheet loading member (pushing plate) 41 in the sheet feed tray 4 are separated by a sheet feed roller (crescent roller) 43 and a separation pad not shown in FIG. 1 and FIG. 2, and are sent sheet-by-sheet to the apparatus body 1. Further, the sheet 10 is sent along a first conveyance guide member 45, a second conveyance guide member 46, and a press member 48 to between a conveyance belt 51 and a press roller 49 in the conveyance device 5. At an apex press roller 47, the sheet 10 is pressed against the conveyance belt 51 and conveyed.

The conveyance device 5 includes, e.g., the conveyance belt 51, a charge roller 54, a platen member 55, a second conveyance roller 56, and a spur unit 57. The conveyance belt 51 is formed into an endless shape, and is looped around a first conveyance roller 52 serving as a driving roller and a driven roller 53. The charge roller 54 charges the conveyance belt 51. The platen member 55 is disposed at a position opposing the image forming unit 2 to maintain the flatness of the conveyance belt 51. The spur unit 57 includes a first spur 58 disposed opposite the driven roller 53 and the second conveyance roller 56.

The conveyance belt 51 is rotated by the rotation of the first conveyance roller 52, which is rotated by a sub-scanning motor 151 via a timing belt 152 and a timing pulley 153. The conveyance belt 51 circulates in a belt conveyance direction (also referred to as sub-scanning direction or sheet conveyance direction) indicated by an arrow BCD shown in FIG. 2.

A rotary encoder (sub-scanning encoder) 156 to detect the moving distance and position of the conveyance belt 51 is provided. The rotary encoder (hereinafter referred to as sub-scanning encoder) 156 includes a high resolution code wheel 154 disposed on a supporting shaft 52*a* of the first conveyance roller 52 and an encoder sensor 155. The encoder sensor 155 is, e.g., a transmissive photosensor to detect the pattern of the code wheel 154.

The sheet output unit 6 includes a third conveyance guide member 61, a first sheet output roller 62A, a second spur 62B, a second sheet output roller 63A, and a third spur 63B. The sheet 10 with an image formed thereon is output from between the second sheet output roller 63A and the third spur 63B onto the sheet output tray 7 in a face down manner.

The sheet reverse unit 8 includes successive reverse conveyance paths 81*a* to 81*c* for reversing the sheet 10 partially output to the sheet output tray 7, and a switching claw 82 for switching conveyance paths to convey the sheet 10 into the reverse conveyance path 81*a*.

The reverse conveyance path 81*a* is formed of the third conveyance guide member 61 and a first guide member 83. The reverse conveyance path 81*b* is formed of the conveyance belt 51 and a second guide member 84. The reverse conveyance path 81*c* is formed of the first conveyance guide member 45 and the second conveyance guide member 46. The reverse conveyance path 81*a* is provided with a third conveyance roller 85 and spurs 88. The reverse conveyance path 81*b* is provided with a first conveyance assistance roller 86 and a second conveyance assistance roller 87. The first conveyance assistance roller 86 and the second conveyance assistance roller 87 are disposed opposite of the driven roller 53 and the first conveyance roller 52, respectively.

In the image forming apparatus having the above-described configuration, the sheets 10 are separated and fed sheet-by-sheet from the sheet feed tray 4. The sheet 10 is attached with electrostatic attraction onto the conveyance belt 51 charged by the charge roller 54, and conveyed in the substantially vertical direction by the circulation of the conveyance belt 51. By driving the recording heads 24 in accordance with image signals while moving the carriage 23, ink droplets are ejected onto the stopped sheet 10 to form one band of a desired image. The sheet 10 is then fed by a certain distance to prepare for recording another band of the image. After the recording of the image is completed, the sheet 10 is discharged to the sheet output tray 7.

In performing maintenance and recovery operation of the nozzles of the recording heads 24, the carriage 23 is moved to a home position opposing the maintenance unit 9 and maintenance and recovery operation, such as nozzle suctioning and preliminary ejection are performed. In nozzle suctioning, with the nozzles capped with the caps 92, liquid droplets not contributing to a resultant image are preliminarily discharged from the nozzles. Such maintenance and recovery operation allows stable droplet ejection for image formation.

Next, an opening structure of the conveyance unit of the image forming apparatus according to an exemplary embodiment of the present disclosure is described with reference to FIG. 3 and FIG. 4.

Figure 3:
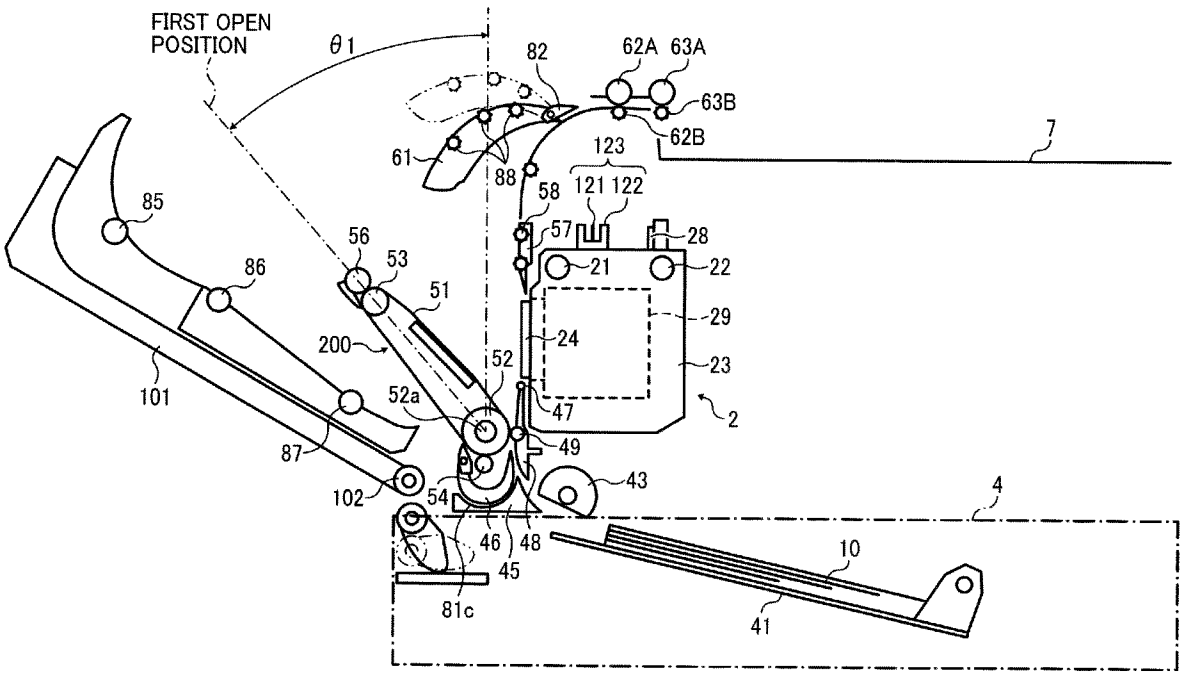
FIG. 3 is a schematic side view of the image forming apparatus in a state in which a conveyance unit is opened to a first open position.

FIG. 3 is a schematic side view of the image forming apparatus in a state in which the conveyance unit is open to a first open position. FIG. 4 is a schematic side view of the image forming apparatus in a state in which the conveyance unit is open to a second open position.

An openable and closable front cover 101 is provided at a front side of the apparatus body 1 so as to pivot around a supporting shaft 102 disposed at a lower end of the front cover 101. The front cover 101 includes the first guide member 83, the second guide member 84, the third conveyance roller 85, the first conveyance assistance roller 86, and the second conveyance assistance roller 87.

The conveyance belt 51, the first conveyance roller 52, the driven roller 53, and the second conveyance roller 56 are integrated as a conveyance unit 200 serving as the conveyance unit. The conveyance unit 200 is openable and closable (in a swinging action) so as to pivot around the supporting shaft 52*a* of the first conveyance roller 52. The third conveyance guide member 61 is also openable and closable (in a swinging action) so as to pivot around a shaft disposed at the switching claw 82 side.

When the front cover 101 is opened, as shown in FIG. 3, the conveyance unit 200 is openable to the first open position at which the conveyance unit 200 is opened at a first angle θ1 from a position at which the conveyance unit 200 opposes the recording heads 24 to convey the sheet 10 (closed position of the conveyance unit 200; hereinafter referred to as "conveyance position"). When an opening authorization mechanism authorizes opening, as shown in FIG. 4, the conveyance unit 200 is openable to the second open position at which the conveyance unit 200 is further moved from the first open position and opened at a second angle θ2 from the conveyance position.

The opening of the conveyance unit 200 is restricted to the first angle θ1 of the first open position. The conveyance unit 200 is unopenable to an angle larger than the first angle θ1 unless the opening authorization mechanism authorizes opening. The opening of the conveyance unit 200 stops at the first angle θ1 when the front cover 101 is opened.

Ink ejection faces of the recording heads 24 are directly untouchable by an apparatus user at an angle at which the first angle θ1 is set.

The opening of the conveyance unit 200 to the first angle θ1 makes a space for placing a hand in to remove sheets when a sheet jam occurs between the recording heads 24 and the conveyance belt 51. Such a configuration facilitates removal of a jammed sheet. In addition, even if a sheet jam occurs in the reverse conveyance paths 81*a* to 81*c* in duplex printing, the above-described configuration of the present embodiment makes a space for placing a hand in to remove sheets between the front cover 101 and the conveyance unit 200, thus facilitating removal of a jammed sheet.

It is to be noted that, if the conveyance unit 200 is opened when there is no sheet jam during printing, the sheet 10 on the conveyance belt 51 would adhere to the conveyance belt 51 due to electrostatic force of the charged conveyance belt 51. With the opening of the conveyance belt 51, the sheet 10 and the conveyance belt 51 as a whole would separate from the side of the recording heads 24.

If printing is continued in the above described state in which the conveyance unit 200 is opened during printing, the ink ejection faces of the recording heads 24 would be exposed and ink droplets would be sprayed outside. As a result, the outside of the apparatus body 1 is stained with ink droplets.

Therefore, a locking configuration is preferable in which the conveyance unit 200 does not open when an apparatus user opens the front cover 101 during normal printing with no sheet jam.

Alternatively, a configuration is preferable in which, if the front cover 101 is opened during normal printing, printing is stopped and the carriage 23 is moved to the home position.

In the present embodiment, the charge roller 54 charges the conveyance belt 51 to provide electrostatic force to the conveyance belt 51. The sheet 10 adheres to the conveyance belt 51 due to electrostatic force. When a sheet jam occurs and the conveyance unit 200 is opened, the sheet 10 and the conveyance belt 51 as a whole move to the first open position. Such a configuration facilitates removal of a jammed sheet. It is to be noted that a method to make the sheet 10 adhere to the conveyance unit 200 and move the sheet 10 and the conveyance unit 200 as a whole is not limited to the above-described method using electrostatic force. For example, a method may be employed in which a fan is disposed in the conveyance unit 200. In such a method, by using a negative pressure generated by the rotation of the fan, the sheet 10 adheres to the conveyance unit 200 and the sheet 10 and the conveyance unit 200 as a whole can be moved. The method in which the fan is employed also facilitates removal of a jammed sheet.

The following is a description of a reason for not allowing the conveyance unit 200 to open more than the first angle θ1. When a sheet jam occurs between the recording heads 24 and the conveyance belt 51, the carriage 23 stops in a printing area and the ink ejection faces of the recording heads 24 are directed outward until a jammed sheet is removed.

To remove the jammed sheet, an apparatus user opens the front cover 101 and then opens the conveyance unit 200. If the opening angle of the conveyance unit 200 is not restricted, the apparatus user might accidentally touch the ink ejection faces of the recording heads 24 when removing the jammed sheet. As a result, ink might undesirably adhere to an apparatus user's hand, and foreign matter adhering to the apparatus user's hand might adhere to the ink ejection faces of the recording heads 24, thus causing nozzle clogging.

In the present embodiment, the first angle θ1, which is an opening angle of the conveyance unit 200, is set to an angle at which the ink ejection faces of the recording heads 24 are untouchable by an apparatus user.

If the opening angle of the conveyance unit 200 is limited to the first angle θ1, the conveyance unit 200 might hinder a serviceperson from making maintenance of the image forming apparatus, for example, cleaning the maintenance unit 9.

Figure 4:
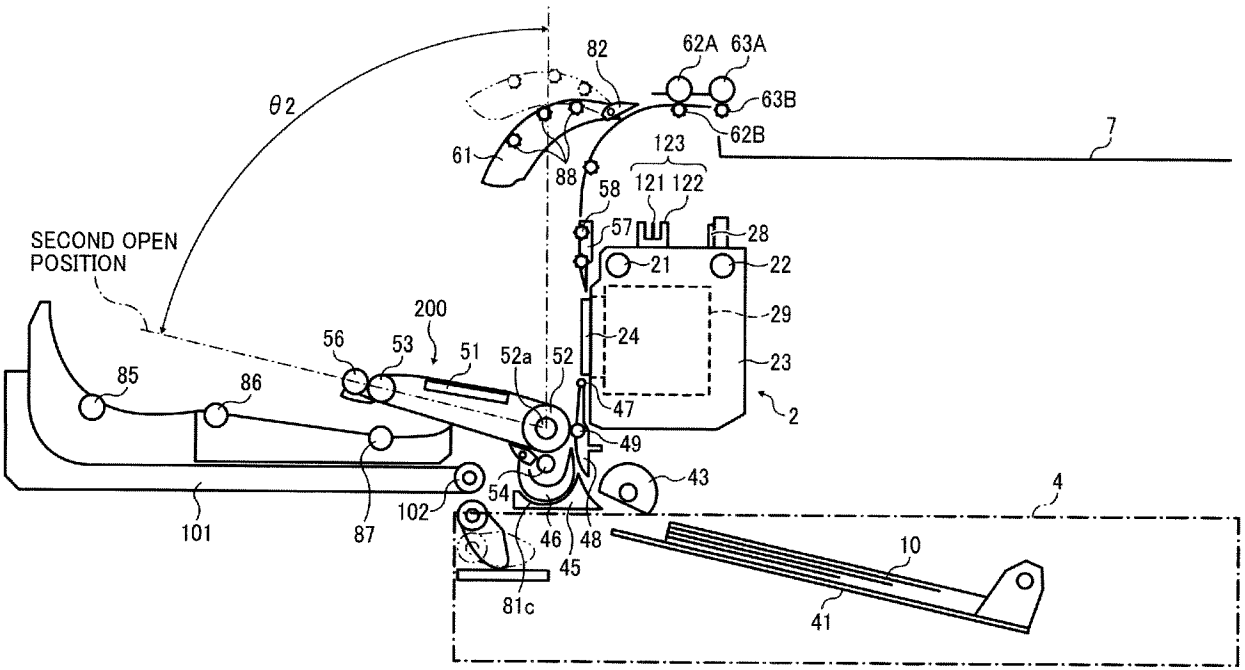
FIG. 4 is a schematic side view of the image forming apparatus in a state in which the conveyance unit is opened to a second open position.

Accordingly, in the present embodiment, when the opening authorization mechanism authorizes opening, the conveyance unit 200 can be opened to the second open position at the second angle θ2 as shown in FIG. 4. The second angle θ2 is a larger angle than the first angle θ1.

The authorization for opening, for example, may be an input of predetermined information to a control panel provided at the apparatus body 1 to authorize the opening of the conveyance unit 200 to the second open position.

Such a configuration facilitates a serviceperson's access to the maintenance unit 9 and a scanning area of the carriage 23 of the image forming apparatus and increases maintenance operation efficiency.

As for the opening of the conveyance unit 200 to the second angle θ2, for example, a configuration is preferable in which the front cover 101 can be opened to a substantially horizontal position with respect to the apparatus body 1 and when the front cover 101 is opened to the substantially horizontal position, the opening of the conveyance unit 200 stops.

Next, a controller of the image forming apparatus according to an exemplary embodiment of the present disclosure is described with reference to FIG. 5.

Figure 5:
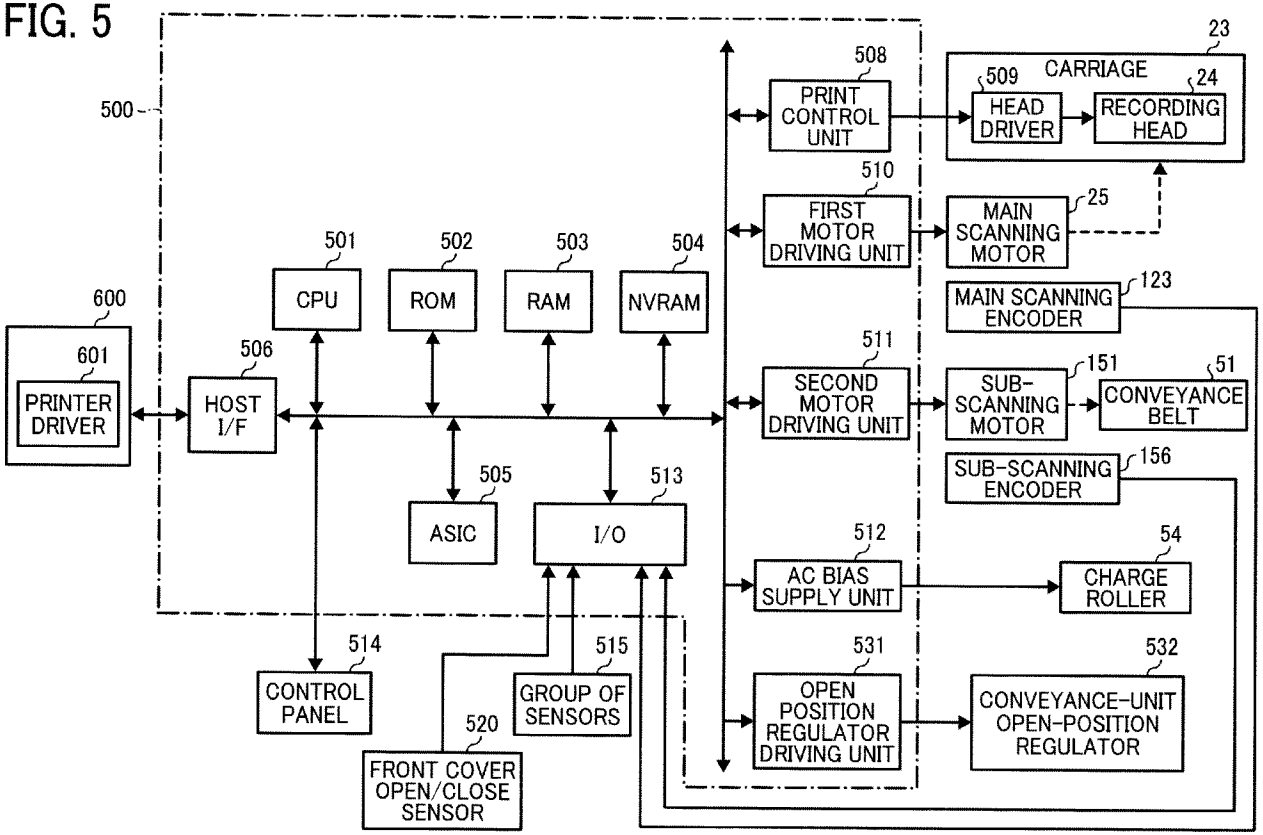
FIG. 5 is a block diagram of a controller of the image forming apparatus.

FIG. 5 is a block diagram of the controller of the image forming apparatus.

In FIG. 5, a controller 500 includes a central processing unit (CPU) 501, a read-only memory (ROM) 502, a random access memory (RAM) 503, a rewritable non-volatile memory 504, and an application specific integrated circuit (ASIC) 505. The CPU 501 controls the entire image forming apparatus. The ROM 502 stores programs, including programs causing the CPU 501 to perform control processing according to exemplary embodiments of the present disclosure, and other fixed data. The RAM 503 temporarily stores image data or other data. The rewritable non-volatile memory 504 retains data even while the apparatus is powered off. The ASIC 505 processes signals for image data, performs image processing, e.g., sorting, or processes input and output signals for controlling the entire image forming apparatus.

The controller 500 also includes a print control unit 508, a head driver (driver integrated circuit) 509, a main scanning motor 25, a first motor driving unit 510 and a second motor driving unit 511, and an alternating current (AC) bias supply unit 512. The print control unit 508 includes a data transmitter and a driving signal generator to drive and control the recording heads 24 according to print data. The head driver 509 drives the recording heads 24 mounted on the carriage 23. The first motor driving unit 510 drives the main scanning motor 25 to move the carriage 23 for scanning. The second motor driving unit 511 drives the sub-scanning motor 151 to circulate the conveyance belt 51. The AC bias supply unit 512 supplies AC bias to the charge roller 54.

The controller 500 is connected to a control panel 514 for inputting and displaying information necessary to the image forming apparatus.

The controller 500 further includes a host interface (I/F) 506 to transmit and receive data and signals to and from a host 600, such as an information processing device (e.g., personal computer), image reading device (e.g., image scanner), or image capturing device (e.g., digital camera) via a cable or a network.

The CPU 501 of the controller 500 reads and analyzes print data stored in a reception buffer of the host I/F 506, performs desired image processing, data sorting, or other processing with the ASIC 505, and transfers image data to the head driver 509. A printer driver 601 of the host 600 creates dot-pattern data for image output.

The print control unit 508 transfers the above-described image data as serial data and outputs to the head driver 509, for example, transfer clock signals, latch signals, and control signals required for the transfer of image data and determination of the transfer. In addition, the print control unit 508 has the driving signal generator including, e.g., a digital/analog (D/A) converter (to perform digital/analog conversion on pattern data of driving pulses stored on the ROM 502), a voltage amplifier, and a current amplifier, and outputs a driving signal containing one or more driving pulses to the head driver 509.

In accordance with serially-inputted image data corresponding to one image band recorded by the recording heads 24, the head driver 509 selects driving pulses forming driving signals transmitted from the print control unit 508 and applies the selected driving pulses to driving elements (e.g., piezoelectric elements) to drive the recording heads 24. At this time, the driving elements generate energy for ejecting liquid droplets from the recording heads 24. At this time, by selecting driving pulses constituting driving signals, liquid droplets of different liquid amounts, such as large-size droplets, medium-size droplets, and small-size droplets, can be selectively ejected to form different sizes of dots.

An input/output unit 513 obtains information from the main-scanning encoder 123, the sub-scanning encoder 156, a group of sensors 515 installed in the image forming apparatus, and a front cover open/close sensor 520 to detect the opened or closed state of the front cover 101. The input/output unit 513 extracts information required for controlling printing operation, and controls the print control unit 508, the first motor driving unit 510, the second motor driving unit 511, and the AC bias supply unit 512 based on the extracted information.

The group of sensors 515 include, for example, an optical sensor (a sheet sensor 521 shown in FIG. 2) disposed at the carriage 23 to detect the position of a sheet, a thermistor to monitor temperature and humidity in the apparatus body 1, a voltage sensor to monitor the voltage of the charged conveyance belt, and an interlock switch to detect the opening and closing of a cover. The I/O unit 513 is capable of processing information from such various types of sensors.

The controller 500 determines a driving output value (control value) for the main scanning motor 25 based on a detected speed value and a detected position value obtained by sampling detected pulses transmitted from the first encoder sensor 122 constituting the main scanning encoder 123 and a target speed value and a target position value obtained from preliminarily-stored speed and position profiles. Further, the controller 500, based on the driving output value, drives the main scanning motor 25 via the first motor driving unit 510. Similarly, the controller 500 determines a driving output value (control value) for the sub-scanning motor 151 based on a detected speed value and a detected position value obtained by sampling detected pulses transmitted from the encoder sensor 155 constituting the sub-scanning encoder 156 and a target speed value and a target position value obtained from preliminarily-stored speed and position profiles. Further, the controller 500, based on the driving output value, drives the sub-scanning motor 151 via the second motor driving unit 511.

The controller 500 also controls a conveyance-unit open-position regulator 532 serving as an open position regulator constituting the opening authorization mechanism. The controller 500 drives the conveyance-unit open-position regulator 532 via an open position regulator driving unit 531 and restricts the opening of the conveyance unit 200 to the first open position. When the controller 500 is instructed to authorize opening, the position of the conveyance unit 200 is changed from the first open position to the second open position.

Next, an example of an opening authorization instruction mechanism, which constitutes an opening authorization mechanism and instructs opening authorization, configured as a control panel of the apparatus body 1 is described with reference to FIG. 6A through FIG. 6C.

Figure 6A:
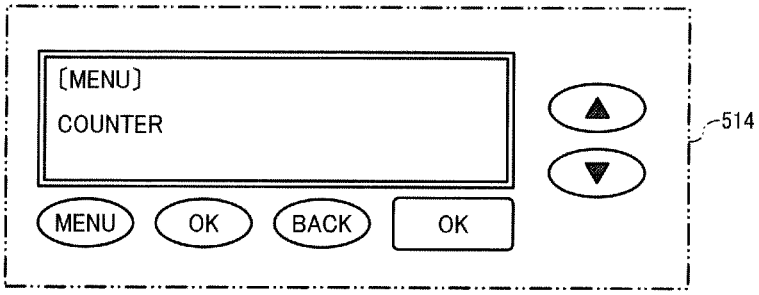
FIG. 6A through FIG. 6C are schematic diagrams of an example of an opening authorization instruction mechanism, which constitutes an opening authorization mechanism and instructs opening authorization, configured as a control panel of an apparatus body.
Figure 6B:
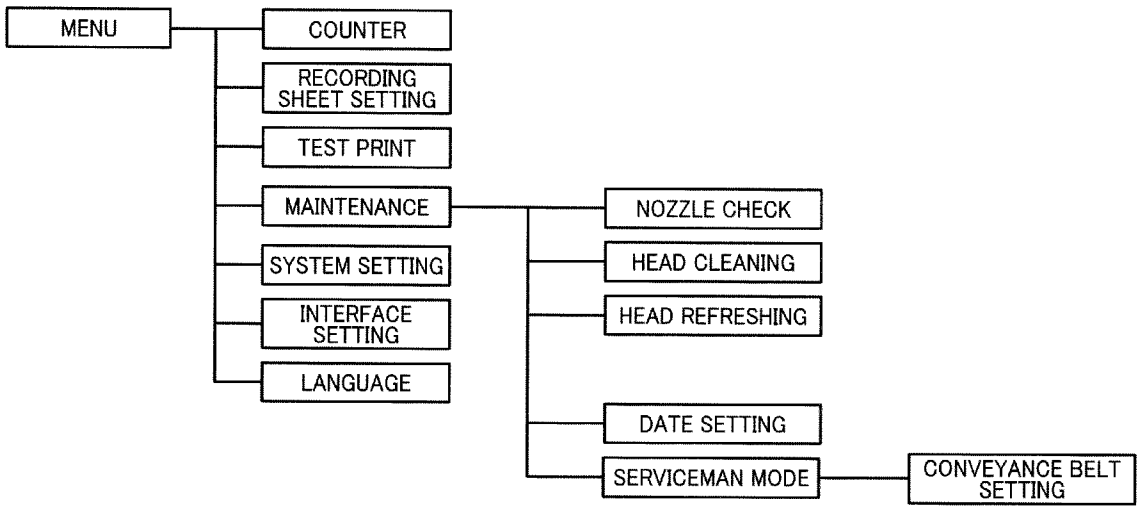
Figure 6C:
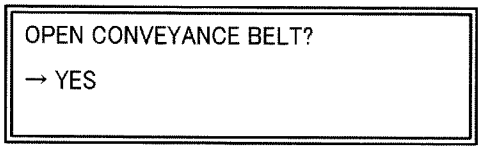

FIG. 6A through FIG. 6C are schematic diagrams of the opening authorization instruction mechanism configured as the control panel of the apparatus body 1.

A control panel 514 as shown in FIG. 6A is provided at a front or side of the apparatus body 1. The control panel 514 is inputted with necessary information relative to the image forming apparatus and displays necessary information. A serviceperson can open the conveyance unit 200 to the second open position with the second angle θ2 by conducting a predetermined operation in the control panel 514.

FIG. 6B shows an example of a hierarchical structure of the control panel 514 to conduct the above described predetermined operation. In the example of FIG. 6, the opening angle (i.e. the open position) of the conveyance unit 200 can be set by selecting a path in the order of menu, maintenance, serviceman mode, and conveyance belt setting in the hierarchical structure.

FIG. 6C shows an example of a confirmation screen regarding the opening of the conveyance belt in the conveyance belt setting. When YES is selected, the conveyance unit 200 can be opened to the second angle θ2 from the first angle θ1.

It is to be noted that the opening of the conveyance unit 200 to the second angle θ2 is conducted by a serviceperson when maintenance of the image forming apparatus is carried out. Thus, it is preferable that opening of the conveyance unit 200 to the second angle θ2 is not allowed by apparatus users.

Accordingly, in the example shown in FIG. 6B, the operation of opening the conveyance unit 200 is placed at a deep level in the hierarchical structure of a menu selection in the control panel 514.

However, even if the setting of opening the conveyance unit 200 is placed at the deep level, an apparatus user might open the conveyance unit 200 to the second angle θ2 by operating the control panel 514. Therefore, in some embodiments, a query for a password known only to the serviceperson to open the conveyance unit 200 to the second angle θ2 is incorporated into the hierarchical structure after YES is selected on the confirmation screen of FIG. 6C regarding the opening of the conveyance belt.

Next, an example of the opening authorization instruction mechanism, which instructs opening authorization, configured as a switch is described with reference to FIG. 7.

Figure 7:
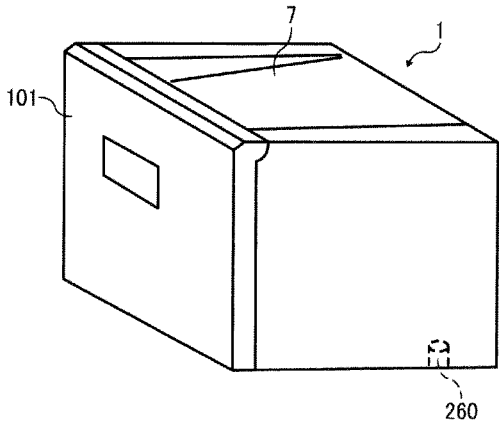
FIG. 7 is a schematic diagram of another example of the opening authorization instruction mechanism to instruct opening authorization, configured as a switch.

FIG. 7 is a schematic diagram of the opening authorization instruction mechanism configured as the switch.

An opening authorization switch 260 that instructs opening authorization is provided at a bottom face of the apparatus body 1.

The conveyance unit 200 can be opened to the second angle θ2 from the first angle θ1 by operating the opening authorization switch 260.

By disposing the opening authorization switch 260 at the bottom face of the apparatus body 1, apparatus users are not aware of the opening authorization switch 260 while normally using the apparatus body 1. Such a configuration can prevent apparatus users other than the serviceperson from opening the conveyance unit 200 to the second angle θ2 by an inadvertent operation of the opening authorization switch 260.

In the above example, the opening authorization switch 260 to instruct authorization for opening the conveyance unit 200 to the second angle θ2 is disposed at the bottom face of the apparatus body 1. It is to be noted that the position of the opening authorization switch 260 is not limited to the bottom face of the apparatus body 1. The opening authorization switch 260 can be disposed at any other position at which inadvertent operation of the opening authorization switch 260 is prevented or apparatus users are not normally aware of the opening authorization switch 260. For example, the opening authorization switch 260 can be disposed at a back side of the apparatus body 1 and covered with a cover so that the opening authorization switch 260 is not viewable.

Next, an example of the conveyance-unit open-position regulator 532 to stop the opening of the conveyance unit 200 at the predetermined first and second open positions is described with reference to FIG. 8A and FIG. 8B.

Figure 8A:
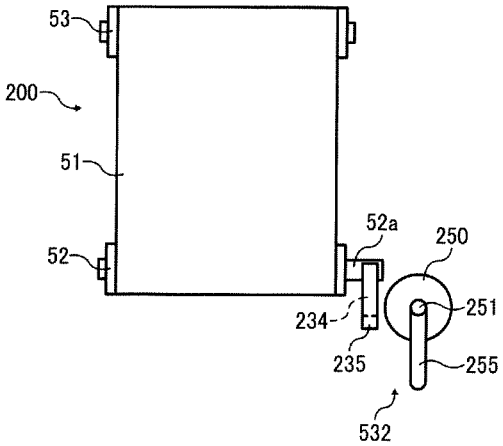
FIG. 8A and FIG. 8B are schematic side views of an example of a conveyance-unit open-position regulator.
Figure 8B:
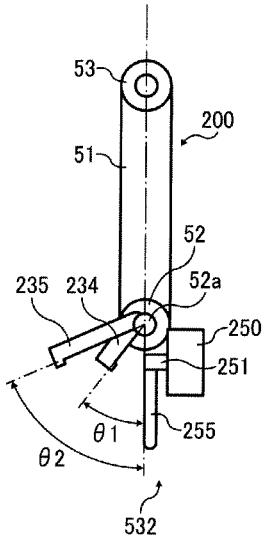

FIG. 8A and FIG. 8B are schematic side views of the conveyance-unit open-position regulator 532. FIG. 8A is a schematic left side view of the conveyance-unit open-position regulator 532 in FIG. 8B. FIG. 8B is a schematic side view of the conveyance-unit open-position regulator 532.

In the conveyance-unit open-position regulator 532, a first rotating member 234 and a second rotating member 235 are coupled and fixed to the supporting shaft 52*a* of the first conveyance roller 52 that acts as the center of rotation when the conveyance unit 200 is opened. The first rotating member 234 and the second rotating member 235 rotate with the supporting shaft 52*a*. In other words, the first rotating member 234 and the second rotating member 235 rotate as one with the conveyance unit 200.

The first rotating member 234 is attached to the supporting shaft 52*a* at the first angle θ1 with respect to the direction of gravitational force. The second rotating member 235 is attached to the supporting shaft 52*a* at the second angle θ2 with respect to the direction of gravitational force. The length of the second rotating member 235 is formed to be longer than the length of the first rotating member 234.

A rotary solenoid 250 serving as an actuator is provided. A pin 255 that restricts the rotation of the first rotating member 234 and the second rotating member 235 is attached to a rotating shaft 251 of the rotary solenoid 250.

By controlling the rotation of the rotary solenoid 250, the pin 255 can be moved to a position at which the rotation of the first rotating member 234 is restricted, a position at which the rotation of the second rotating member 235 is restricted, and a position at which the rotation of each of the first rotating member 234 and the second rotating member 235 is not restricted (i.e. normal driving of the conveyance belt 51).

The difference in the position of restriction between the first rotating member 234 and the second rotating member 235 is, as described above, due to the length of the second rotating member 235 being formed longer than the length of the first rotating member 234. By interposing the pin 255 between the first rotating member 234 and the second rotating member 235, the first rotating member 234 is not restricted by the pin 255 and the second rotating member 235 is restricted by the pin 255.

Next, an action of the conveyance-unit open-position regulator 532 is described with reference to FIG. 9A, FIG. 9B, FIG. 10A, and FIG. 10B.

Figure 9B:
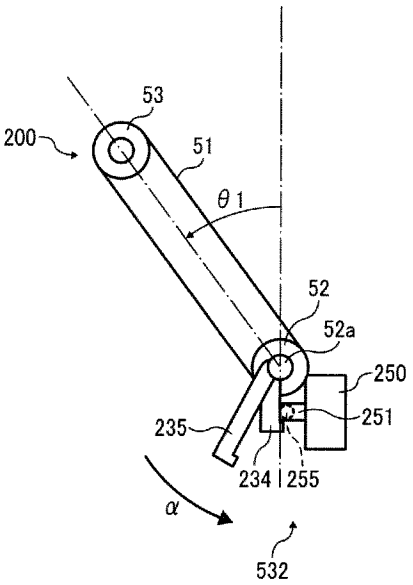
FIG. 9A and FIG. 9B are schematic diagrams of an action of the conveyance-unit open-position regulator to open the conveyance unit to the first open position.
Figure 9A:
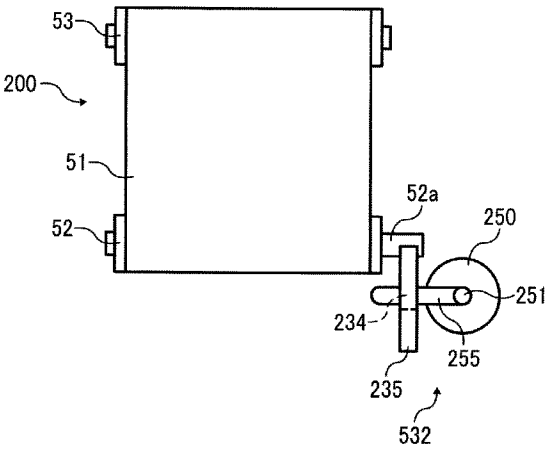
Figure 10B:
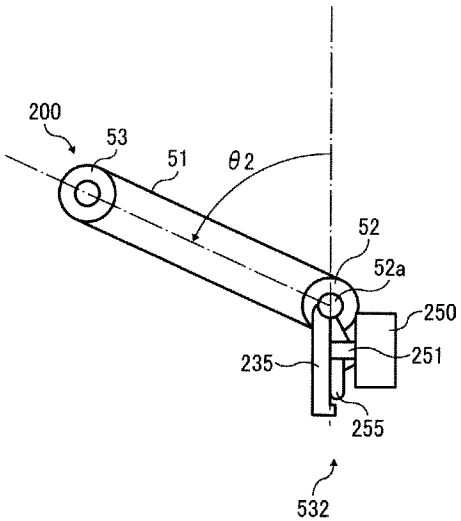
FIG. 10A and FIG. 10B are schematic diagrams illustrating an action of the conveyance-unit open-position regulator to open the conveyance unit to the second open position.
Figure 10A:
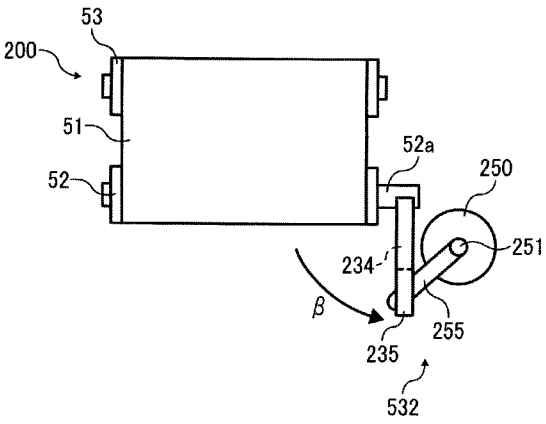

FIG. 9A and FIG. 9B are schematic diagrams of a state in which the conveyance unit 200 is opened to the first open position. FIG. 10A and FIG. 10B are schematic diagrams of a state in which the conveyance unit 200 is opened to the second open position.

As described above, FIG. 8A and FIG. 8B illustrates a state in which the conveyance belt 51 is stopped and the conveyance unit is not opened.

When the conveyance unit 200 is opened from the state illustrated in FIG. 8A and FIG. 8B and stopped at the first angle θ1 (i.e. the first open position), the rotary solenoid 250 is rotated to place the pin 255 at a position at which the pin 255 contacts the first rotating member 234 as shown in FIG. 9A and FIG. 9B.

With the opening of the conveyance unit 200, the first rotating member 234 and the second rotating member 235 rotate in a direction indicated by an arrow α in FIG. 9B.

When the conveyance unit 200 is rotated to the first angle θ1, the first rotating member 234 contacts the pin 255, which is attached to the rotary solenoid 250 and directed in a substantially horizontal direction to restrict further rotation, thus stopping the opening action of the conveyance unit 200. As a result, the conveyance unit 200 stops at the first open position with the first angle θ1.

When authorization for opening the conveyance unit 200 to the second open position is instructed, as illustrated in FIG. 10A, the rotation of the rotary solenoid 250 is controlled to rotate the pin 255, which is directed in the substantially horizontal direction, in a direction indicated by an arrow β to a position at which the pin 255 is lower than the first rotating member 234 and contacts the second rotating member 235. As a result, the restriction of the conveyance belt 51 at the first angle θ1 is canceled.

Accordingly, when the conveyance unit 200 is further opened toward the front cover 101, the second rotating member 235 longer than the first rotating member 234 contacts the pin 255 and the opening of the conveyance unit 200 stops. When the opening of the conveyance unit 200 is stopped by the pin 255, the opening angle is the second angle θ2 because the second rotating member 235 is attached to the supporting shaft 52*a* at the second angle θ2 with respect to the direction of gravitational force.

In the present embodiment, by using the rotary solenoid 250, the position of the pin 255 serving as a stopper is changed to stop the conveyance unit 200 at the first angle θ1 and at the second angle θ2. It is to be noted that the configuration of stopping the conveyance unit 200 at the first angle θ1 and at the second angle θ2 is not limited to the above-described configuration of the present embodiment.

Figure 11:
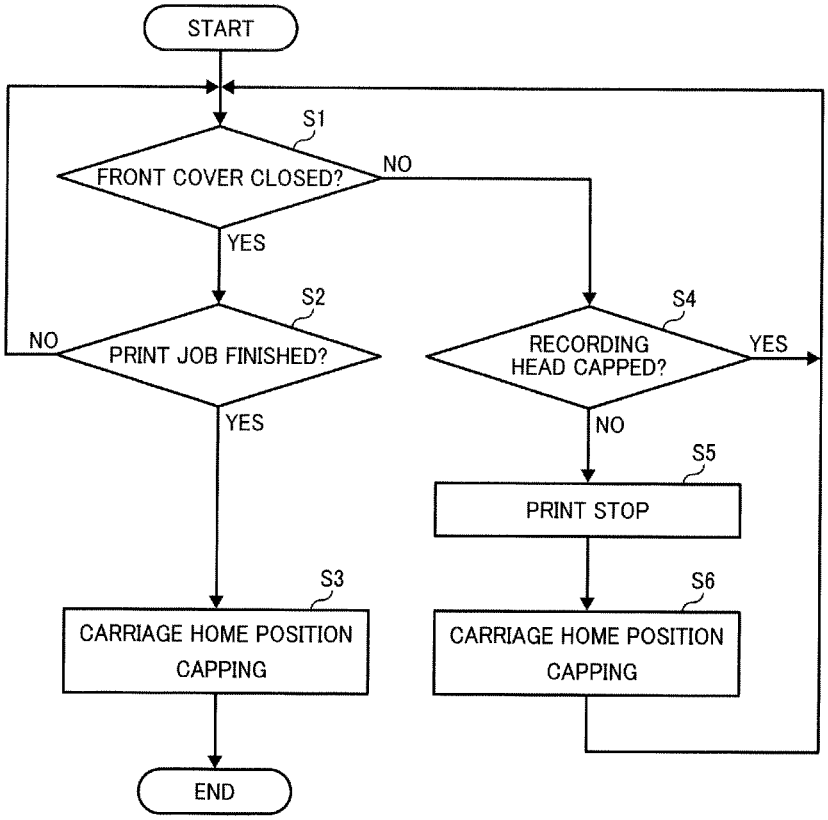
FIG. 11 is a flow chart of an example of control of printing operation according to an exemplary embodiment of this disclosure.

Next, an example of control of a printing action of the image forming apparatus according to an exemplary embodiment of this disclosure is described with reference to a flow chart shown in FIG. 11.

When printing is started, at a step S1, the front cover open/close sensor 520 is checked during scanning of the carriage 23 to determine whether the front cover 101 is open or closed. When the front cover 101 is closed, at a step S2, it is determined whether a print job is finished or not. Until the print job is finished, it is repeatedly detected whether the front cover 101 is closed or not.

When the print job is finished with the front cover 101 closed, at a step S3, the carriage 23 is returned to the home position and the ink ejection faces of the recording heads 24 are capped with the caps 92.

By contrast, if the front cover 101 is opened during printing, as described above, the conveyance unit would be opened and ink droplets would be sprayed from the recording heads 24 to the outside.

To prevent the spraying of ink droplets to the outside, when the front cover 101 is opened during printing, at a step S4, it is determined whether the ink ejection faces of the recording heads 24 are capped or not. If the ink ejection faces of the recording heads 24 are not capped, at a step S5, the printing is immediately stopped. After stopping the printing, at a step S6, the carriage 23 is returned to the home position and the ink ejection faces of the recording heads 24 are capped.

After the step S6, it is determined whether the front cover 101 is closed or not, and printing is stopped and on standby until the front cover 101 is closed.

If the closing of the front cover 101 is detected and a print job is remaining, the printing action is executed. After the print job is finished, the carriage 23 is moved to the home position and the ink ejection faces of the recording heads 24 are capped.

The control of the printing action in the above-described manner prevents liquid droplets from ejecting from the recording heads 24 to the outside when an apparatus user opens the conveyance unit 200 during printing.

In the above-described exemplary embodiments of the present disclosure, the sheet is conveyed in a vertical direction, which is an upward and downward direction, and liquid droplets are horizontally ejected. However, in some embodiments, the sheet is conveyed in a direction inclined relative to the vertical direction, which is also an upward and downward direction, and liquid droplets are horizontally ejected or ejected at a direction inclined relative to the substantially horizontal direction.

As described above, the image forming apparatus according to any of the exemplary embodiments of the present disclosure facilitates removal of jammed sheets, prevents accidental contact with the droplet ejection face, and facilitates maintenance works.

What is claimed is:

1. An image forming apparatus, comprising:

an apparatus body;

an openable and closable cover provided at the apparatus body;

a conveyance unit to convey a recording medium upward and downward;

a recording head to eject liquid droplets to the recording medium conveyed by the conveyance unit to form an image on the recording medium; and an opening authorization mechanism to authorize moving of the conveyance unit from a first open position to a second open position, the first open position located at a position in same direction as a direction in which the cover is opened, the conveyance unit having a greater opening amount at the second open position than at the first open position, wherein the conveyance unit is disposed between the cover and the recording head, and configured to be openable to the first open position when the cover is in the open position, and openable to the second open position when the opening authorization mechanism authorizes the moving of the conveyance unit from the first open position to the second open position.

2. The image forming apparatus of claim 1, wherein the conveyance unit has, at the first open position, an angle at which a droplet ejection face of the recording head is untouchable and, at the second open position, an angle at which the droplet ejection face of the recording head is touchable.

3. The image forming apparatus of claim 1, wherein the opening authorization mechanism includes an open position regulator to restrict an open position of the conveyance unit; and the open position regulator is configured to restrict opening of the conveyance unit to the first open position when the opening authorization mechanism does not authorize the moving of the conveyance unit from the first open position to the second open position and change the open position of the conveyance unit to the second open position from the first open position when the opening authorization mechanism authorizes the moving of the conveyance unit from the first open position to the second open position.

4. The image forming apparatus of claim 1, wherein the opening authorization mechanism includes an instruction mechanism to instruct opening authorization for opening the conveyance unit to the second open position.

5. The image forming apparatus of claim 4, wherein the instruction mechanism includes a menu selection of an operation unit provided at the apparatus body.

6. The image forming apparatus of claim 4, wherein the instruction mechanism is provided at a bottom portion of the apparatus body.

* * * * *